US008769803B2

(12) United States Patent
Koike et al.

(10) Patent No.: US 8,769,803 B2
(45) Date of Patent: Jul. 8, 2014

(54) SPEAKER MANUFACTURING METHOD

(75) Inventors: Toshiyuki Koike, Mie (JP); Shinsaku Sawa, Mie (JP); Tadashi Akiyama, Hokkaido (JP)

(73) Assignee: Panasonic Corporation, Osaka (JP)

( * ) Notice: Subject to any disclaimer, the term of this patent is extended or adjusted under 35 U.S.C. 154(b) by 169 days.

(21) Appl. No.: 13/581,134

(22) PCT Filed: Mar. 30, 2011

(86) PCT No.: PCT/JP2011/001896
§ 371 (c)(1),
(2), (4) Date: Aug. 24, 2012

(87) PCT Pub. No.: WO2011/122017
PCT Pub. Date: Oct. 6, 2011

(65) Prior Publication Data

US 2012/0317792 A1 Dec. 20, 2012

(30) Foreign Application Priority Data

Mar. 30, 2010 (JP) ..... 2010-078345

(51) Int. Cl.
*H04R 31/00* (2006.01)

(52) U.S. Cl.
USPC ..... 29/594; 29/592.1; 29/609.1; 381/113; 381/116; 381/174; 381/191

(58) Field of Classification Search
USPC ..... 29/592.1, 594, 602.1, 609.1; 381/113, 381/116, 191, 174, 182, 186
See application file for complete search history.

(56) References Cited

U.S. PATENT DOCUMENTS

| | | | | |
|---|---|---|---|---|
| 4,472,604 | A * | 9/1984 | Nakamura et al. | 381/425 |
| 5,701,657 | A * | 12/1997 | Sakamoto | 29/594 |
| 6,817,084 | B2 * | 11/2004 | Tokusho et al. | 29/594 |
| 7,724,915 | B2 * | 5/2010 | Matsumura et al. | 381/421 |
| 2009/0116681 | A1 | 5/2009 | Sadaie et al. | |
| 2011/0317869 | A1 * | 12/2011 | Fujitani et al. | 381/423 |
| 2013/0259291 | A1 * | 10/2013 | Fujitani | 381/423 |

FOREIGN PATENT DOCUMENTS

| | | |
|---|---|---|
| JP | 04-296199 | 10/1992 |
| JP | 05-014995 | 1/1993 |
| JP | 09-149498 | 6/1997 |
| JP | 2009-260577 | 11/2009 |

OTHER PUBLICATIONS

International Search Report of PCT Application No. PCT/JP2011/001896 dated Jul. 5, 2011.

* cited by examiner

*Primary Examiner* — Paul D Kim
(74) *Attorney, Agent, or Firm* — Panasonic Patent Center

(57) ABSTRACT

Provided is a method of manufacturing a loudspeaker including assembling a magnetic circuit and a frame. In the step of assembling the magnetic circuit and the frame, parallelism between a plate and a damper attachment portion of the frame is ensured by bringing an upper portion of the plate and the damper attachment portion of the frame into contact with a jig. In addition, perpendicularity between a magnetic gap and the damper attachment portion of the frame is ensured by bringing an outer circumferential side portion of the plate of the magnetic gap and an inner circumferential side portion of the yoke into contact with the jig. The magnetic circuit and the frame are assembled in such a state. With such a manufacturing method, it is possible to achieve a superior loudspeaker capable of reducing a gap defect while being downsized and having increased maximum input power.

5 Claims, 8 Drawing Sheets

SPEAKER MANUFACTURING METHOD

This application is a U.S. national phase application of PCT international application PCT/JP2011/001896 filed on Mar. 30, 2011 which has a priority based on Japanese application JP2010-078345 filed on Mar. 30, 2010.

BACKGROUND

1. Technical Field

The present invention relates to a method of manufacturing a loudspeaker for an in-car application or used in various audio equipment and the like.

2. Background Art

In recent years, in the automobile industry and the audiovisual industry, downsizing of automobiles, electronic devices such as audiovisual equipment, and loudspeakers used for such applications has been demanded in order to promote energy savings and to improve environmental responsiveness and a space factor. At the same time, high maximum input power, high quality, and high reliability are also demanded in order to improve performance of loudspeakers.

In the following, a conventional method of manufacturing a loudspeaker is described with reference to the drawings. FIG. 8 is a chart showing steps of the conventional method of manufacturing a loudspeaker. FIG. 9 is a cross-sectional view illustrating a loudspeaker manufactured through the conventional method of manufacturing a loudspeaker.

As illustrated in FIG. 8 and FIG. 9, first, magnetic circuit 104 is assembled by attaching magnet 101 and plate 102 to yoke 103. At this time, plate 102 and yoke 103 are attached without decentering by guiding an outer circumference of plate 102 and an inner circumference of yoke 103 by a gap gauge (not depicted) such that a size of magnetic gap 105 of magnetic circuit 104 is accurately ensured.

Next, yoke 103 of magnetic circuit 104 is inserted into a central portion of an inner bottom surface of frame 106 along a side of a yoke insertion portion of frame 106, and coupled by an adhesive agent.

Then, an assembly of voice coil 108 and damper 109 that have been assembled through another step is attached to a damper attachment portion of frame 106. At this time, by guiding an inner circumference of voice coil 108 and the outer circumference of plate 102 by a spacer (not depicted), voice coil 108 is inserted into magnetic gap 105 so as not to be decentered.

Next, diaphragm 107 is coupled to a peripheral portion of frame 106 via an edge, and diaphragm 107 is coupled to voice coil 108 for driving diaphragm 107.

Finally, dust cap 110 is coupled to a front surface of diaphragm 107, and thus a loudspeaker is completed.

Here, known information of prior art documents relating to the present invention includes PTL 1, for example.

However, according to the conventional method of manufacturing a loudspeaker, if yoke 103 of magnetic circuit 104 is obliquely coupled to the central portion of the inner bottom surface of frame 106 when assembling magnetic circuit 104 and frame 106, a gap defect occurs due to the obliquity.

Conceivable factors of such obliquity include dimensional tolerance of component parts such as frame 106, yoke 103, magnet 101, and plate 102, and accumulation of obliquity and displacement occurring when these component parts are coupled.

Additionally, the factors can include an uneven condition of the attachment between the central portion of the inner bottom surface of frame 106 and yoke 103 of magnetic circuit 104 due to uneven thickness of an adhesive agent applied to the central portion of the inner bottom surface of frame 106. Specifically, even if the size of magnetic gap 105 of magnetic circuit 104 is accurately ensured, magnetic circuit 104 and frame 106 are often assembled obliquely in this manner. In such a case, when voice coil 108 vibrates up and down, voice coil 108 is brought into contact with magnetic gap 105 to generate a gap defect. Here, the generation of the gap defect tends to be more noticeable as amplitude of a voice coil in a magnetic gap becomes larger due to downsizing and increased maximum input power of a loudspeaker.

CITATION LIST

Patent Literature

PTL 1: Unexamined Japanese Patent Publication No. H09-149498

SUMMARY

The present invention relates to a manufacturing method for providing a superior loudspeaker capable of reducing a gap defect while being downsized and having increased maximum input power.

A method of manufacturing a loudspeaker according to the present invention includes the steps of assembling a magnetic circuit having a yoke, a magnet, and a plate; assembling the magnetic circuit and a frame; assembling a voice coil and a damper; inserting the voice coil into a magnetic gap of the magnetic circuit, and coupling the frame with the damper; and inserting and fixing the voice coil into and to a diaphragm, and assembling the frame and the diaphragm. In the step of assembling the magnetic circuit and the frame, parallelism between a plate and a damper attachment portion of the frame is ensured by bringing an upper portion of the plate and the damper attachment portion of the frame into contact with a jig. In addition, perpendicularity between a magnetic gap and the damper attachment portion of the frame is ensured by bringing an outer circumferential side portion of the plate of the magnetic gap and an inner circumferential side portion of the yoke into contact with the jig. The magnetic circuit and the frame are assembled in such a state.

With such a manufacturing method, it is possible to achieve a superior loudspeaker capable of reducing a gap defect while being downsized and having increased maximum input power.

DESCRIPTION OF EMBODIMENTS

Hereinafter, an embodiment according to the present invention will be described with reference to the drawings.

First Exemplary Embodiment

Figure 1:
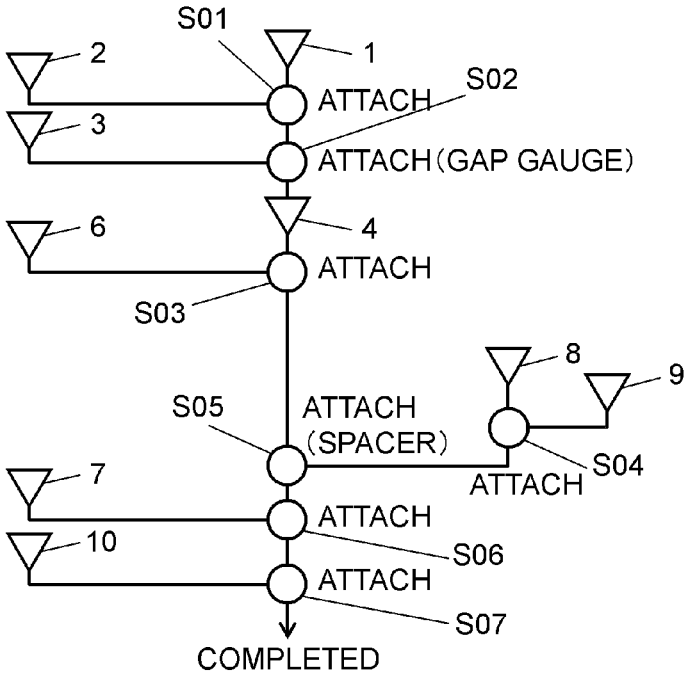
FIG. 1 is a chart showing steps of a method of manufacturing a loudspeaker according to the present invention.
Figure 2:
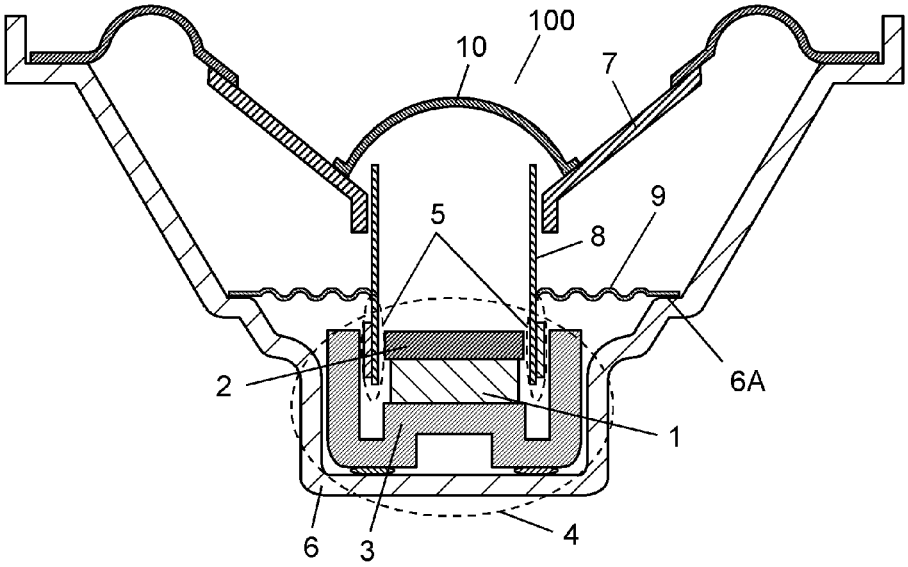
FIG. 2 is a cross-sectional view illustrating a loudspeaker manufactured through the method of manufacturing a loudspeaker according to the present invention.
Figure 3:
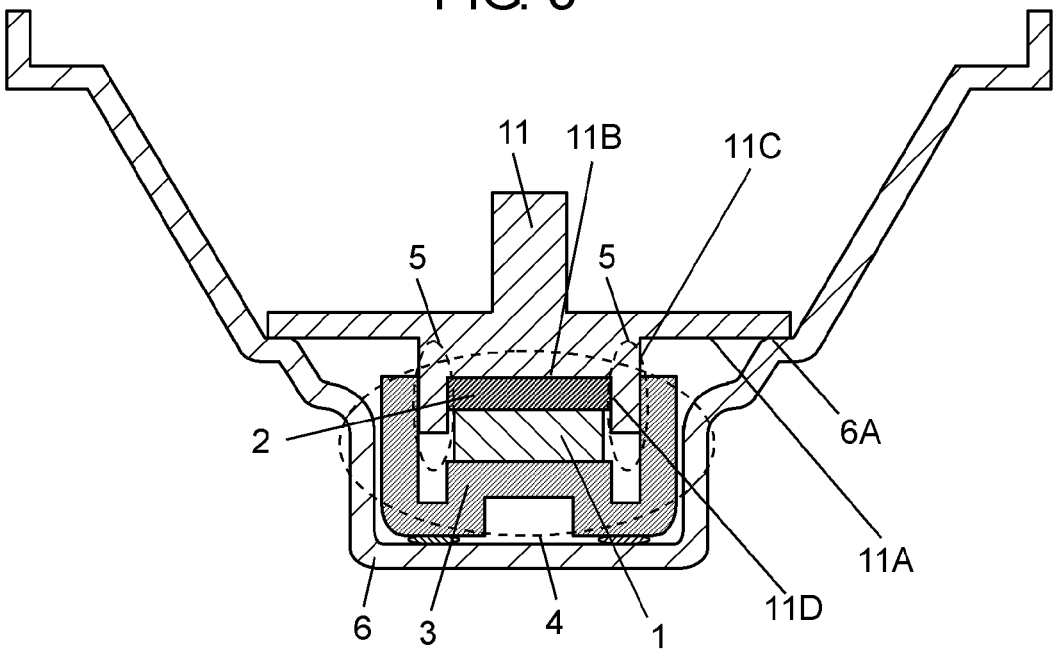
FIG. 3 is a cross-sectional view illustrating the loudspeaker manufactured through the method of manufacturing a loudspeaker according to the present invention and a jig in the middle of manufacturing.

The following describes a method of manufacturing a loudspeaker according to a first exemplary embodiment with reference to FIG. 1 to FIG. 3.

FIG. 1 is a chart showing steps of the method of manufacturing a loudspeaker according to this embodiment. FIG. 2 is a cross-sectional view illustrating a loudspeaker manufactured through the method of manufacturing a loudspeaker according to this embodiment. FIG. 3 is a cross-sectional view illustrating the loudspeaker manufactured through the method of manufacturing a loudspeaker according to this embodiment and a jig in the middle of manufacturing.

Referring to FIG. 2, loudspeaker 100 is provided with a magnetic circuit 4, frame 6, diaphragm 7, voice coil 8, damper 9, and dust cap 10. Magnetic circuit 4 is configured by assembling magnet 1, plate 2, and yoke 3. Magnet 1 is configured from neodymium, plate 2 is configured by a magnetic metallic body, and yoke 3 is configured by magnetic metallic body. Further, magnetic circuit 4 includes magnetic gap 5 between an inner periphery of yoke 3 and an outer periphery of plate 2. Frame 6 includes planar damper attachment portion 6A. One end of damper 9 is attached to damper attachment portion 6A. Voice coil 8 is joined to the other end of damper 9, and coupled to diaphragm 7. Diaphragm 7 is coupled to a peripheral portion of frame 6 via an edge. Frame 6 is configured by a resin molded component or a metallic body, damper 9 is configured by a resin-impregnated cloth, and diaphragm 7 is configured by paper or a resin. Dust cap 10 is coupled to diaphragm 7 so as to cover magnetic circuit 4 and voice coil 8 from above.

In the following, the method of manufacturing loudspeaker 100 will be described according to an order of the steps shown in FIG. 1.

First, the step of assembling magnetic circuit 4 will be described (Steps S01 and S02). Magnetic circuit 4 is assembled by attaching magnet 1 and plate 2 to yoke 3. Magnetic gap 5 is provided between a surface of the inner periphery of yoke 3 and a surface of the outer periphery of plate 2. At this time, plate 2 and yoke 3 are attached by guiding an outer circumference of plate 2 and an inner circumference of yoke 3 by a gap gauge such that a size of magnetic gap 5 of magnetic circuit 4 is accurately ensured. With this, plate 2 and yoke 3 are attached without decentering.

Next, the step of assembling frame 6 with magnetic circuit 4 will be described (Step S03). Referring to FIG. 3, yoke 3 of magnetic circuit 4 is attached and fixed to a central portion of a bottom surface of frame 6 by an adhesive agent. In the assembly, an upper portion of plate 2 and damper attachment portion 6A of frame 6 are brought into contact with jig 11, and therefore parallelism between the upper portion of plate 2 and a top surface of damper attachment portion 6A is ensured. Along with this, an outer circumferential side portion of plate 2 of magnetic gap 5 and an inner circumferential side portion of yoke 3, as well as damper attachment portion 6A of frame 6 are brought into contact with jig 11, and therefore perpendicularity between an outer circumferential side surface of plate 2 and damper attachment portion 6A and perpendicularity between an inner circumferential side surface of yoke 3 and damper attachment portion 6A are respectively ensured. Specifically, perpendicularity between magnetic gap 5 and damper attachment portion 6A of frame 6 is ensured.

On the other hand, voice coil 8 and damper 9 are attached and assembled (Step S04).

Next, frame 6 and damper 9 to which voice coil 8 is attached are coupled (Step S05). The one end of damper 9 in the assembly of voice coil 8 and damper 9 is joined to damper attachment portion 6A of frame 6. At this time, the assembling is performed while guiding the inner circumference of voice coil 8 and the outer circumference of plate 2 by a spacer (not depicted). With this, voice coil 8 may not be decentered in magnetic gap 5.

Next, frame 6 and diaphragm 7 are coupled (Step S06). Specifically, diaphragm 7 is coupled to the peripheral portion of frame 6 via the edge. Further, voice coil 8 for driving diaphragm 7 is inserted into and fixed to diaphragm 7 to be coupled.

Finally, dust cap 10 is coupled to the front surface of diaphragm 7, and thus a loudspeaker is completed (Step S07).

Now, jig 11 used in the step of assembling frame 6 and magnetic circuit 4 described above (Step S03) will be described.

Jig 11 includes plane 11A and plane 11B provided in parallel to each other. Jig 11 further includes plane 11C and plane 11D provided in parallel to each other and perpendicular to plane 11A and plane 11B. Further, jig 11 is provided such that plane 11A and plane 11C perpendicularly intersect.

In Step S03, plane 11A of jig 11 is brought into contact with the top surface of damper attachment portion 6A in parallel to each other, and plane 11B is brought into contact with a top surface of plate 2 in parallel to each other. With this, it is possible to provide damper attachment portion 6A and the top surface of plate 2 in parallel to each other. Further, along with this, plane 11C is brought into contact with the inner circumferential side surface of yoke 3 in parallel to each other, and plane 11D is brought into contact with the outer circumferential side surface of plate 2 in parallel to each other. With this, it is possible to provide damper attachment portion 6A perpendicularly to the inner circumferential side surface of yoke 3, and to provide damper attachment portion 6A perpendicularly to the outer circumferential side surface of plate 2. By fixing magnetic circuit 4 to frame 6 while ensuring such a condition, it is possible to prevent obliquity and displacement from occurring when assembling.

Here, a length between plane 11A and plane 11B is the same as a distance between the top surface of damper attachment portion 6A and the top surface of plate 2 in a completed loudspeaker in a height direction. Further, a length between plane 11C and plane 11D is the same as a length between the inner periphery of yoke 3 of magnetic circuit 4 and the outer periphery of plate 2, that is, a length of magnetic gap 5.

It should be noted that jig 11 illustrated in FIG. 3 is a mere example, and it is possible to provide the same effect as the manufacturing method according to this embodiment as long as the jig includes sections corresponding to planes 11A to 11D as described above.

As described above, jig 11 ensures parallelism by bringing a part of jig 11 into contact with the top surface of plate 2 and with the top surface of damper attachment portion 6A of frame 6. Further, jig 11 ensures perpendicularity between the outer circumferential side portion of plate 2 and the top surface of damper attachment portion 6A and perpendicularity between the inner circumferential side portion of yoke 3 and the top surface of damper attachment portion 6A by bringing a part of jig 11 into contact with the outer circumferential side portion of plate 2 of magnetic gap 5 and with the inner circumferential side portion of yoke 3, as well as by bringing a part of jig 11 into contact with the top surface of damper attachment portion 6A of frame 6.

According to the method of manufacturing a loudspeaker of this embodiment, parallelism between plate 2 and damper attachment portion 6A of frame 6 is ensured by bringing the upper portion of plate 2 and damper attachment portion 6A of frame 6 into contact with jig 11 in the step of assembling magnetic circuit 4 and frame 6. Along with this, perpendicularity between magnetic gap 5 and damper attachment portion 6A of frame 6 is ensured by bringing the outer circumferential side portion of plate 2 of magnetic gap 5 and the inner circumferential side portion of yoke 3 into contact with jig 11. By assembling magnetic circuit 4 and frame 6 in this manner, it is possible to prevent displacement from occurring due to dimensional tolerances of frame 6 and component parts such as yoke 3, magnet 1, and plate 2 that constitute magnetic circuit 4. Further, it is possible to prevent obliquity from being generated due to obliquity or displacement when these component parts are coupled, or due to uneven thickness of the adhesive agent between the central portion of the bottom surface of frame 6 and yoke 3 of magnetic circuit 4. Thus, it is possible to assemble a loudspeaker with very high accuracy. Therefore, it is possible to reduce a gap defect while achieving downsizing and increased maximum input power of the loudspeaker.

Here, according to this embodiment, jig 11 is configured by incorporating two jigs: a jig for ensuring parallelism between plate 2 and damper attachment portion 6A by being brought into contact with the upper portion of plate 2 and the top surface of damper attachment portion 6A of frame 6; and a jig for ensuring perpendicularity between magnetic gap 5 and the top surface of damper attachment portion 6A of frame 6 by being brought into contact with the outer circumferential side portion of plate 2 and the inner circumferential side portion of yoke 3 in magnetic gap 5. This improves productivity of jigs and allows cost reduction. Further, in addition to the jig, it is also possible to ensure levelness and perpendicularity at the same time when assembling magnetic circuit 4 and frame 6 of the loudspeaker, and thus to improve productivity of loudspeakers and allow cost reduction.

Figure 4:
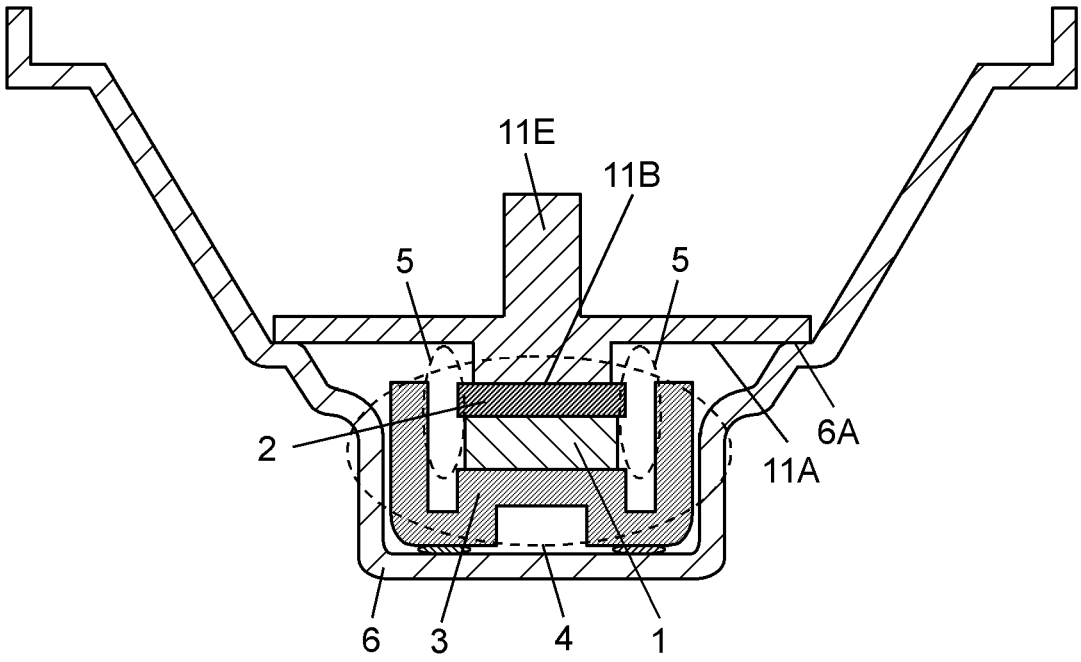
FIG. 4 is a cross-sectional view illustrating the loudspeaker and a different jig in the middle of manufacturing in an embodiment according to the present invention.
Figure 5:
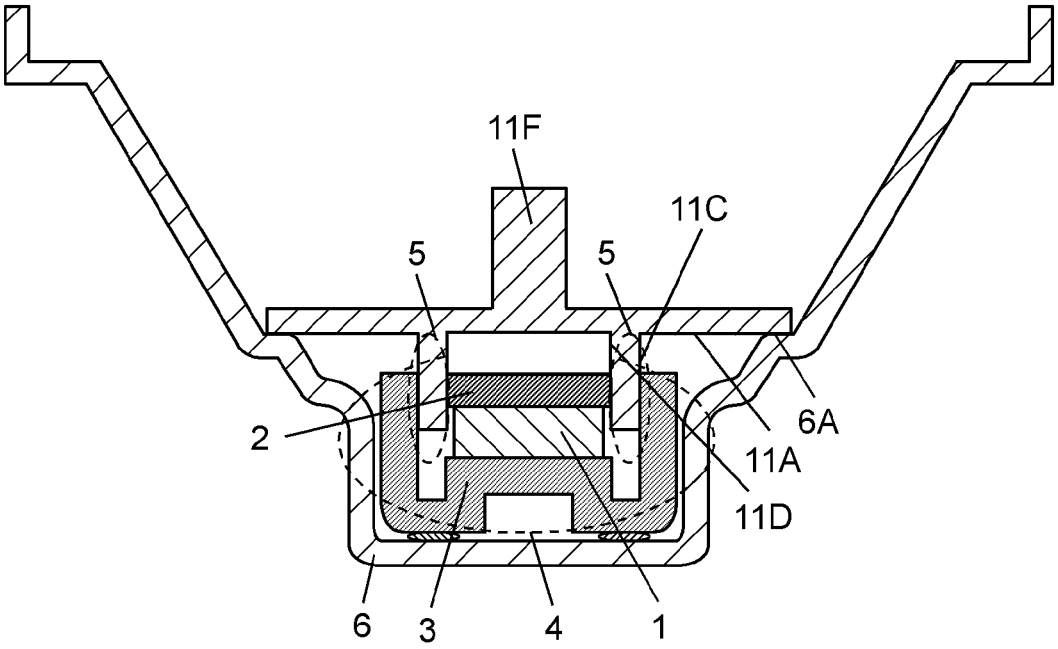
FIG. 5 is a cross-sectional view illustrating the loudspeaker and a different jig in the middle of manufacturing in the embodiment according to the present invention.

However, not limited to the above example, as illustrated in FIG. 4 and FIG. 5, these jigs can be provided and used separately. Jig 11E illustrated in FIG. 4 ensures parallelism between plate 2 and damper attachment portion 6A of frame 6 by bringing the upper portion of plate 2 and damper attachment portion 6A of frame 6 into contact with jig 11E. Further, jig 11F illustrated in FIG. 5 ensures perpendicularity between magnetic gap 5 and damper attachment portion 6A of frame 6 by bringing the outer circumferential side portion of plate 2 of magnetic gap 5 and the inner circumferential side portion of yoke 3 into contact with jig 11F. In this manner, by manufacturing jig 11 separated in two parts of jigs 11E and 11F, it is possible to accurately assemble the component parts of magnetic circuit 4 and parts with poor dimensional accuracy in frame 6, while productivity in assembling of jig 11 and the loudspeaker is reduced.

Figure 6A:
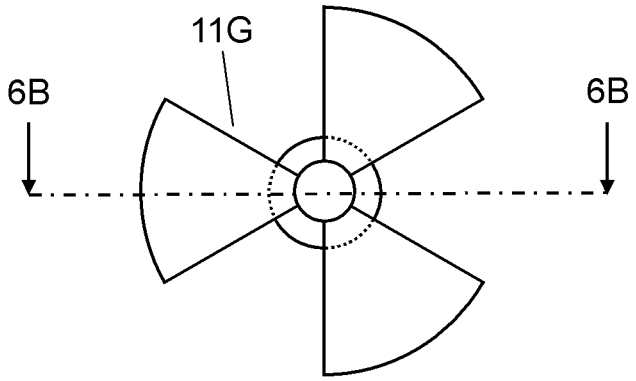
FIG. 6A is a top view illustrating a different jig in the embodiment according to the present invention.
Figure 6B:
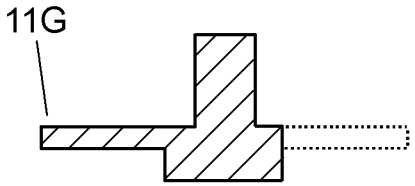
FIG. 6B is a cross-sectional view illustrating a different jig in the embodiment according to the present invention.
Figure 7A:
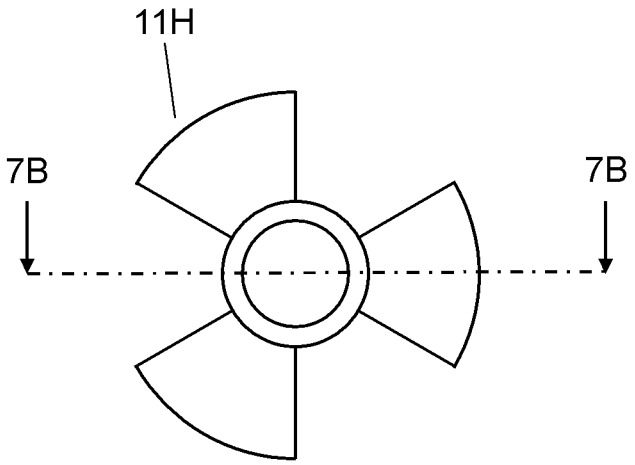
FIG. 7A is a top view illustrating a different jig in the embodiment according to the present invention.
Figure 7B:
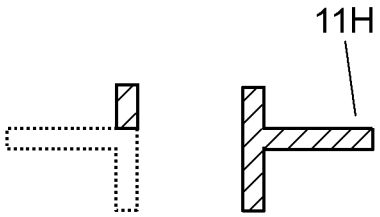
FIG. 7B is a cross-sectional view illustrating a different jig in the embodiment according to the present invention.
Figure 8:
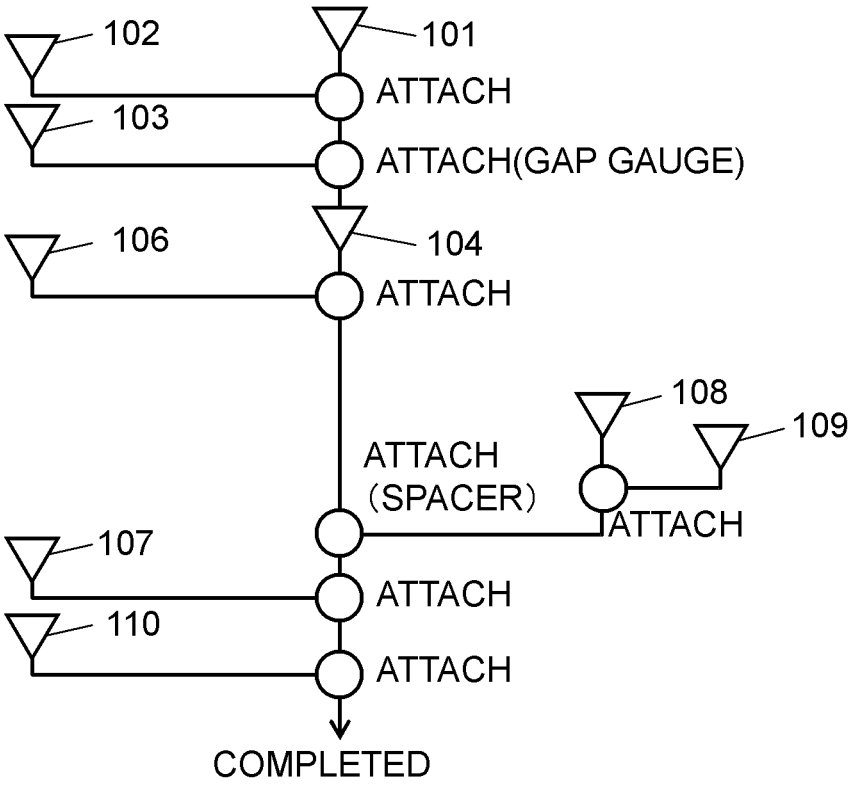
FIG. 8 PRIOR ART
FIG. 8 is a chart showing steps of a conventional method of manufacturing a loudspeaker.
Figure 9:
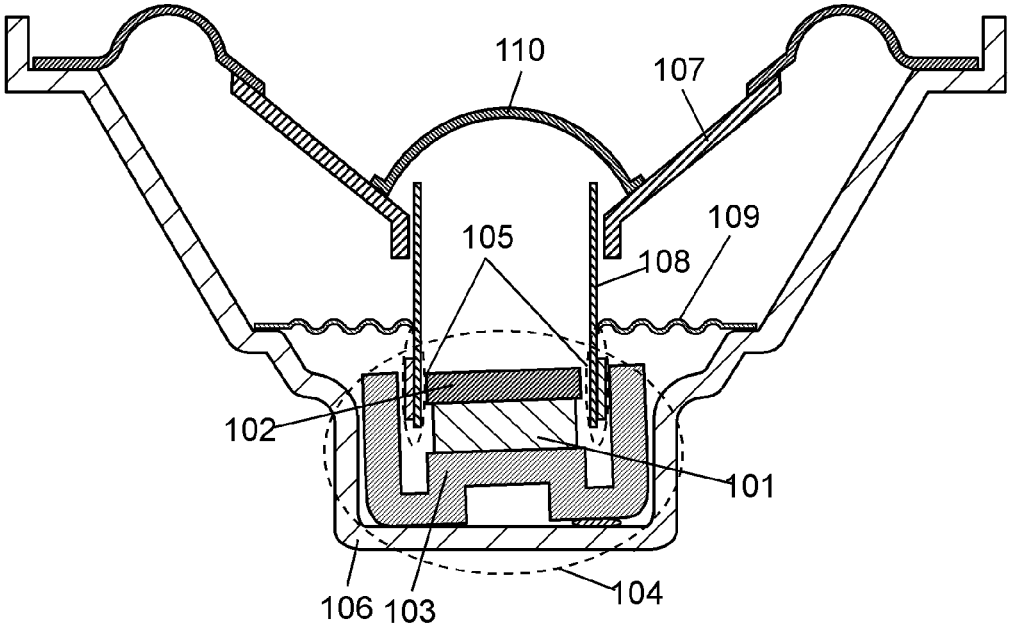
FIG. 9 PRIOR ART
FIG. 9 is a cross-sectional view illustrating a loudspeaker manufactured through the conventional method of manufacturing a loudspeaker.

Additionally, when using jig 11 in the separate two parts, as illustrated in FIG. 6A, FIG. 6B, FIG. 7A, and FIG. 7B, two jigs 11G and 11H can be provided at different angles so as not to overlap with each other in planar view from the top surface. FIG. 6A and F*ig*.7A are top views respectively illustrating jigs 11G and 11H. Further, FIG. 6B and FIG. 7B are cross-sectional views respectively illustrating jigs 11G and 11H. With this, it is possible to use jigs 11G and 11H at the same time, as well as to improve productivity and accuracy of the loudspeaker. Specifically, first, parallelism between the upper portion of plate 2 and the top surface of damper attachment portion 6A is ensured by jig 11G illustrated in FIG. 6A and FIG. 6B, and then in a state in which jig 11G remains received, perpendicularity between magnetic gap 5 and damper attachment portion 6A of frame 6 is ensured by inserting jig 11H illustrated in FIG. 7A and FIG. 7B into a space of jig 11G. In this manner, as jig 11 is configured by two parts, it is possible to accurately assemble the component parts of magnetic circuit 4 and parts with poor dimensional accuracy in frame 6. Further, as two jigs 11G and 11H can be used at the same time, it is possible to improve productivity of loudspeakers. While each of two jigs 11G and 11H is divided in three parts and then combined in this case, the three is required as a minimum number of holding units in order to maintain a center of circularity of the magnetic gap, for example. The number is not limited to this, and the jig can be divided into more than three parts.

Moreover, jig 11 can be provided by a resin. With this, it is possible to further improve productivity and to reduce cost for the jig.

Furthermore, jig 11 can be provided by a metal. With this, it is possible to improve dimensional stability against temperatures and humidity. In addition, it is possible to improve a durability performance of the jig.

By providing a best suited manufacturing method using different materials for jig 11 depending on types of loudspeakers to be manufactured, it is possible to provide a manufacturing method with higher accuracy and stability, and to further reduce a gap defect.

The method of manufacturing a loudspeaker according to the present invention is applicable to loudspeakers for which reduction of gap defects is demanded.

What is claimed is:

1. A method of manufacturing a loudspeaker, the method comprising the steps of:

assembling a magnetic circuit having a yoke, a magnet, and a plate;

assembling the magnetic circuit and a frame;

assembling a voice coil and a damper;

inserting the voice coil into a magnetic gap of the magnetic circuit, and coupling the frame with the damper; and inserting and fixing the voice coil into and to a diaphragm, and assembling the frame and the diaphragm, wherein in the step of assembling the magnetic circuit and the frame, the magnetic circuit and the frame are assembled, while parallelism between the plate and a damper attachment portion of the frame is ensured by bringing an upper portion of the plate and the damper attachment portion of the frame into contact with a jig, and while perpendicularity between the magnetic gap and the damper attachment portion of the frame is ensured by bringing an outer circumferential side portion of the plate of the magnetic gap and an inner circumferential side portion of the yoke into contact with the jig.

2. The method of manufacturing a loudspeaker according to claim 1, wherein the jig is configured by incorporating: a jig for ensuring parallelism between the plate and the damper attachment portion of the frame by being brought into contact with the upper portion of the plate and the damper attachment portion of the frame; and a jig for ensuring perpendicularity between the magnetic gap and the damper attachment portion of the frame by being brought into contact with the outer circumferential side portion of the plate of the magnetic gap and the inner circumferential side portion of the yoke.

3. The method of manufacturing a loudspeaker according to claim 1, wherein the jig is configured by a resin.

4. The method of manufacturing a loudspeaker according to claim 1, wherein the jig is configured by a metal.

5. The method of manufacturing a loudspeaker according to claim 1, wherein the jig includes a first plane and a second plane provided in parallel to each other, the jig further includes a third plane and a fourth plane provided in parallel to each other and perpendicular to the first plane and the second plane, and in the step of assembling the magnetic circuit and the frame, parallelism between the damper attachment portion and a top surface of the plate is ensured by bringing the first plane of the jig into contact with the top surface of the damper attachment portion in parallel to each other, and by bringing the second plane into contact with the top surface of the plate in parallel to each other, and perpendicularity between the damper attachment portion and the magnetic gap is ensured by bringing the third plane into contact with an inner circumferential side surface of the yoke in parallel to each other, and by bringing the fourth plane into contact with a circumferential side surface of the plate in parallel to each other.

* * * * *